US008198968B2

(12) United States Patent
Oliaei et al.

(10) Patent No.: US 8,198,968 B2
(45) Date of Patent: Jun. 12, 2012

(54) SYSTEM AND METHOD FOR MULTIPLE BAND TRANSMISSION

(75) Inventors: Omid Oliaei, Tempe, AZ (US); Amit Bavisi, Gilbert, AZ (US)

(73) Assignee: Fujitsu Semiconductor Limited, Kanagawa (JP)

( * ) Notice: Subject to any disclaimer, the term of this patent is extended or adjusted under 35 U.S.C. 154(b) by 77 days.

(21) Appl. No.: 12/895,086

(22) Filed: Sep. 30, 2010

(65) Prior Publication Data

US 2012/0081203 A1 Apr. 5, 2012

(51) Int. Cl.

| | |
|---|---|
| ***H01F 27/29*** | (2006.01) |
| ***H01F 21/02*** | (2006.01) |
| ***H01F 21/12*** | (2006.01) |
| ***H01F 27/28*** | (2006.01) |

(52) U.S. Cl. ..... 336/192; 336/145; 336/150; 336/182

(58) Field of Classification Search ..... 336/145, 336/146, 147, 150, 182, 192, 232; 330/190, 330/197

See application file for complete search history.

(56) References Cited

U.S. PATENT DOCUMENTS

| | | | | |
|---|---|---|---|---|
| 4,779,058 | A * | 10/1988 | Meyer | 330/188 |
| 4,816,784 | A * | 3/1989 | Rabjohn | 333/24 R |
| 6,577,219 | B2 * | 6/2003 | Visser | 336/200 |
| 6,707,367 | B2 * | 3/2004 | Castaneda et al. | 336/200 |
| 7,088,214 | B2 * | 8/2006 | Castaneda et al. | 336/200 |
| 7,365,602 | B2 | 4/2008 | Bhatti et al. | 330/295 |
| 7,369,096 | B2 * | 5/2008 | Castaneda et al. | 343/859 |
| 7,750,783 | B2 * | 7/2010 | Hasegawa et al. | 336/61 |
| 7,796,970 | B2 * | 9/2010 | Rofougaran et al. | 455/333 |
| 7,973,636 | B2 * | 7/2011 | Yoon et al. | 336/223 |
| 2004/0108927 | A1 | 6/2004 | Castaneda et al. | 336/10 |

* cited by examiner

*Primary Examiner* — Lincoln Donovan
*Assistant Examiner* — Joselito Baisa
(74) *Attorney, Agent, or Firm* — Baker Botts L.L.P.

(57) ABSTRACT

In accordance with embodiments of the present disclosure, a multi-tap integrated transformer may include one or more windings, wherein each of the one or more windings include at least one pair of primary taps for receiving at least one differential input signal, a first pair of secondary taps for outputting a first output signal, and a second pair of secondary taps for outputting a second output signal. The first and second output signals may be based on the at least one differential input signal and a mutual inductance between portions of the one or more windings associated with the at least one pair of primary taps, the first pair of secondary taps, and the second pair of secondary taps.

22 Claims, 5 Drawing Sheets

SYSTEM AND METHOD FOR MULTIPLE BAND TRANSMISSION

TECHNICAL FIELD

The present disclosure relates generally to wireless communication and, more particularly, to transmission of wireless communications in multiple frequency bands.

BACKGROUND

Wireless communications systems are used in a variety of telecommunications systems, television, radio and other media systems, data communication networks, and other systems to convey information between remote points using wireless transmitters and wireless receivers. A transmitter is an electronic device which, usually with the aid of an antenna, propagates an electromagnetic signal such as radio, television, or other telecommunications. Transmitters often include signal amplifiers which receive a radio-frequency or other signal, amplify the signal by a predetermined gain, and communicate the amplified signal. On the other hand, a receiver is an electronic device which, also usually with the aid of an antenna, receives and processes a wireless electromagnetic signal. In certain instances, a transmitter and receiver may be combined into a single device called a transceiver.

In many modern wireless communication systems, it may desirable to transmit wireless signals at multiple frequencies or "bands." Traditionally, transmitters include multiple transmit chains (essentially, multiple transmitters) in order to support transmission at multiple frequencies. Traditional transmitters often used this approach as separate transformers were required for each frequency. Transformers used in transmitters are often integrated on a semiconductor chip (e.g., in a CMOS process), and thus may be referred to as integrated transformers.

A transformer is a device that transfers electrical energy from one circuit to another through inductively coupled conductors—the transformer's coils—via a phenomenon known as mutual induction. With mutual induction, a varying current in a primary winding of a transformer creates a varying magnetic flux in a core of the transformer about which the windings are wound, and thus a varying magnetic field through the secondary winding. This varying magnetic field induces a varying electromotive force (EMF) or voltage in the secondary winding. If a load is connected to the secondary, an electric current will flow in the secondary winding and electrical energy will be transferred from the primary circuit through the transformer to the load. In an ideal transformer, the induced voltage in the secondary winding is in proportion to the primary voltage, and is given by the ratio of the number of turns in the secondary to the number of turns in the primary.

SUMMARY

In accordance with embodiments of the present disclosure, multi-tap integrated transformer may include a primary winding and a secondary winding. The a primary winding may have a plurality of primary winding taps coupled thereto, the plurality of primary winding taps including a pair of primary winding taps configured to receive a differential input signal. The secondary winding may have a plurality of secondary winding taps coupled thereto, the plurality of secondary winding taps including a first pair of secondary winding taps configured to output a first output signal and a second pair of secondary winding taps configured to output a second output signal. The first output signal may be based on the differential input signal and a first mutual inductance between a portion of the primary winding between the pair of primary winding taps and a first portion of the secondary winding between the first pair of secondary winding taps. The second output signal may be based on the differential input signal and a second mutual inductance between the portion of the primary winding between the pair of primary winding taps and a second portion of the secondary winding between the second pair of secondary winding taps, the second mutual inductance different than the first mutual inductance.

In accordance with the same or alternative embodiments of the present disclosure, a multi-tap integrated transformer may include a primary winding and a secondary winding. The primary winding may have a plurality of primary winding taps coupled thereto, the plurality of primary winding taps including a first pair of secondary winding taps configured to receive a first differential input signal and a second pair of primary winding taps configured to receive a first differential input signal. The secondary winding may have a plurality of secondary winding taps coupled thereto, the plurality of secondary winding taps including a first pair of secondary winding taps configured to output a first output signal and a second pair of secondary winding taps configured to output a second output signal. The first output signal may be based on the first differential input signal and a first mutual inductance between a first portion of the primary winding between the first pair of primary winding taps and a first portion of the secondary winding between the first pair of secondary winding taps. The second output signal may be based on the second differential input signal and a second mutual inductance between a second portion of the primary winding between the second pair of primary winding taps and a second portion of the secondary winding between the second pair of secondary winding taps, the second mutual inductance different than the first mutual inductance.

In accordance with these and other embodiments of the present disclosure, a multi-tap integrated transformer may include a winding having a plurality of taps coupled thereto. The plurality of taps may include a pair of primary taps, a first pair of secondary taps, and a second pair of secondary taps. The pair of primary taps may be configured to receive a differential input signal. The first pair of secondary taps may be configured to output a first output signal. The second pair of secondary taps may be configured to output a second output signal.

Technical advantages of one or more embodiments of the present disclosure may include a multi-band transmitter with a reduced number of integrated transformers, as compared with traditional transmitters.

It will be understood that the various embodiments of the present disclosure may include some, all, or none of the enumerated technical advantages. In addition, other technical advantages of the present disclosure may be readily apparent to one skilled in the art from the figures, description and claims included herein.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
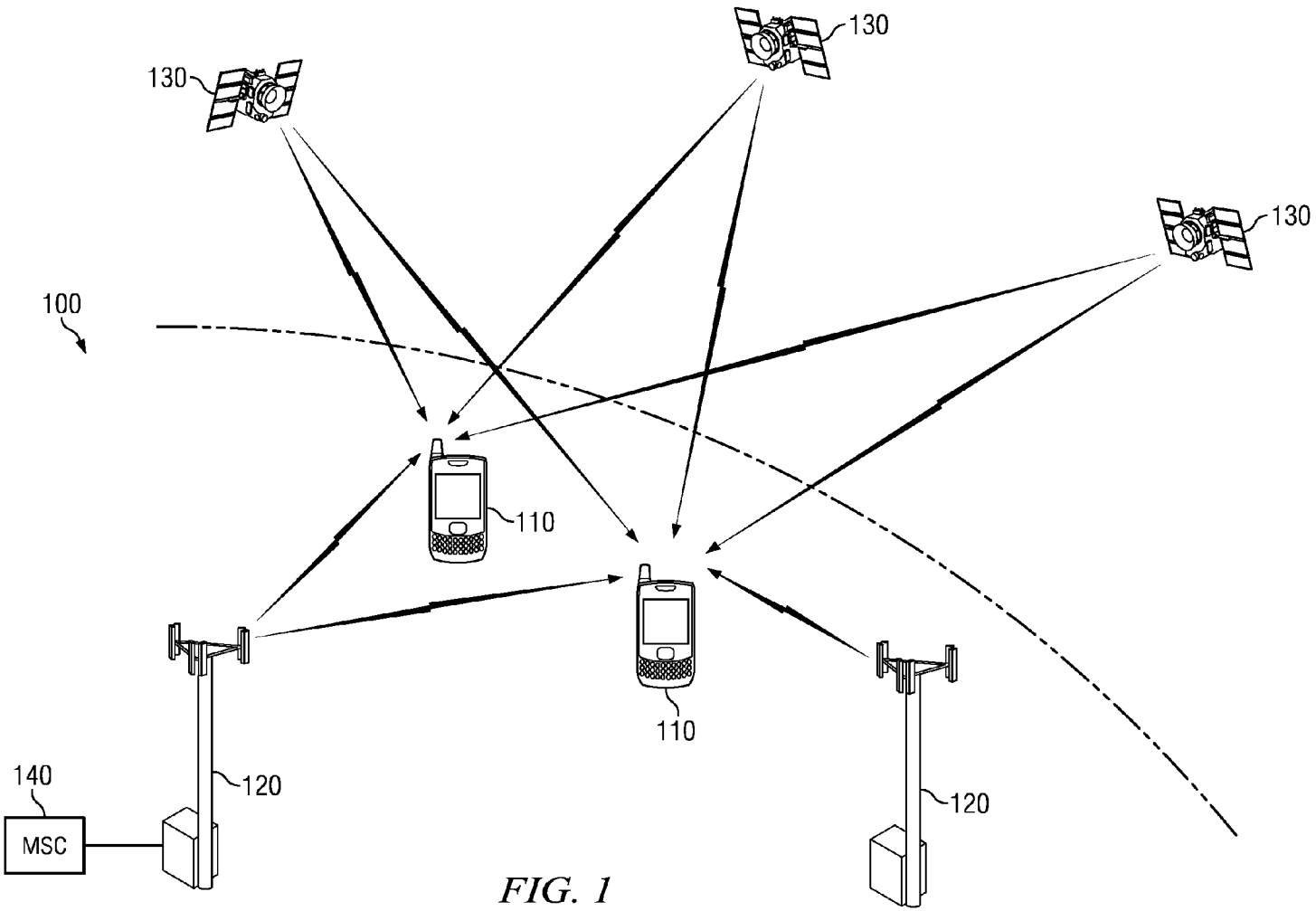
FIG. 1 illustrates a block diagram of an example wireless communication system, in accordance with certain embodiments of the present disclosure.

FIG. 1 illustrates a block diagram of an example wireless communication system 100, in accordance with certain embodiments of the present disclosure. For simplicity, only two terminals 110 and two base stations 120 are shown in FIG. 1. A terminal 110 may also be referred to as a remote station, a mobile station, an access terminal, user equipment (UE), a wireless communication device, a cellular phone, or some other terminology. A base station 120 may be a fixed station and may also be referred to as an access point, a Node B, or some other terminology. A mobile switching center (MSC) 140 may be coupled to the base stations 120 and may provide coordination and control for base stations 120.

A terminal 110 may or may not be capable of receiving signals from satellites 130. Satellites 130 may belong to a satellite positioning system such as the well-known Global Positioning System (GPS). Each GPS satellite may transmit a GPS signal encoded with information that allows GPS receivers on earth to measure the time of arrival of the GPS signal. Measurements for a sufficient number of GPS satellites may be used to accurately estimate a three-dimensional position of a GPS receiver. A terminal 110 may also be capable of receiving signals from other types of transmitting sources such as a Bluetooth transmitter, a Wireless Fidelity (Wi-Fi) transmitter, a wireless local area network (WLAN) transmitter, an IEEE 802.11 transmitter, and any other suitable transmitter.

In FIG. 1, each terminal 110 is shown as receiving signals from multiple transmitting sources simultaneously, where a transmitting source may be a base station 120 or a satellite 130. In certain embodiments, a terminal 110 may also be a transmitting source. In general, a terminal 110 may receive signals from zero, one, or multiple transmitting sources at any given moment.

System 100 may be a Code Division Multiple Access (CDMA) system, a Time Division Multiple Access (TDMA) system, or some other wireless communication system. A CDMA system may implement one or more CDMA standards such as IS-95, IS-2000 (also commonly known as "1x"), IS-856 (also commonly known as "1xEV-DO"), Wideband-CDMA (W-CDMA), and so on. A TDMA system may implement one or more TDMA standards such as Global System for Mobile Communications (GSM). The W-CDMA standard is defined by a consortium known as 3GPP, and the IS-2000 and IS-856 standards are defined by a consortium known as 3GPP2.

Figure 2:
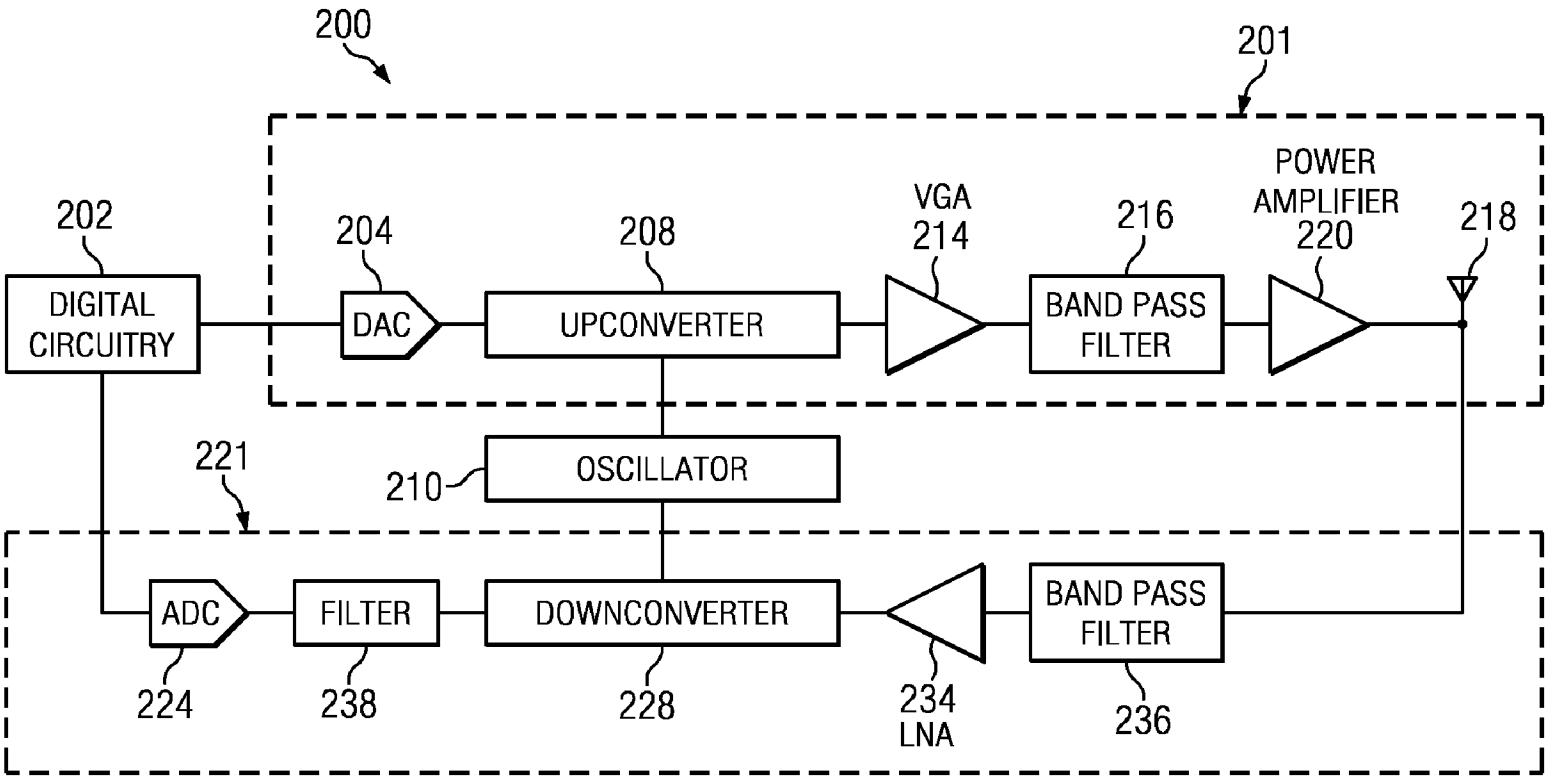
FIG. 2 illustrates a block diagram of selected components of an example transmitting and/or receiving element, in accordance with certain embodiments of the present disclosure.

FIG. 2 illustrates a block diagram of selected components of an example transmitting and/or receiving element 200 (e.g., a terminal 110, a base station 120, or a satellite 130), in accordance with certain embodiments of the present disclosure. Element 200 may include a transmit path 201 and/or a receive path 221. Depending on the functionality of element 200, element 200 may be considered a transmitter, a receiver, or a transceiver.

As depicted in FIG. 2, element 200 may include digital circuitry 202. Digital circuitry 202 may include any system, device, or apparatus configured to process digital signals and information received via receive path 221, and/or configured to process signals and information for transmission via transmit path 201. Such digital circuitry 202 may include one or more microprocessors, digital signal processors, and/or other suitable devices.

Transmit path 201 may include a digital-to-analog converter (DAC) 204. DAC 204 may be configured to receive a digital signal from digital circuitry 202 and convert such digital signal into an analog signal. Such analog signal may then be passed to one or more other components of transmit path 201, including upconverter 208.

Upconverter 208 may be configured to frequency upconvert an analog signal received from DAC 204 to a wireless communication signal at a radio frequency based on an oscillator signal provided by oscillator 210. Oscillator 210 may be any suitable device, system, or apparatus configured to produce an analog waveform of a particular frequency for modulation or upconversion of an analog signal to a wireless communication signal, or for demodulation or downconversion of a wireless communication signal to an analog signal. In some embodiments, oscillator 210 may be a digitally-controlled crystal oscillator.

Transmit path 201 may include a variable-gain amplifier (VGA) 214 to amplify an upconverted signal for transmission, and a bandpass filter 216 configured to receive an amplified signal VGA 214 and pass signal components in the band of interest and remove out-of-band noise and undesired signals. The bandpass filtered signal may be received by power amplifier 220 where it is amplified for transmission via antenna 218. Antenna 218 may receive the amplified and transmit such signal (e.g., to one or more of a terminal 110, a base station 120, and/or a satellite 130).

As mentioned previously, certain components of transmit path 201 may include transformers. For example, upconverter 208, variable gain amplifier 214, power amplifier 220, and/or another component of transmit path 201 may include transformers, including without limitation, the multi-tap transformers discussed in detail with respect to FIGS. 3A-3E and 4, below.

Receive path 221 may include a bandpass filter 236 configured to receive a wireless communication signal (e.g., from a terminal 110, a base station 120, and/or a satellite 130) via antenna 218. Bandpass filter 236 may pass signal components in the band of interest and remove out-of-band noise and undesired signals. In addition, receive path 221 may include a low-noise amplifier (LNA) 224 to amplify a signal received from bandpass filter 236.

Receive path 221 may also include a downconverter 228. Downconverter 228 may be configured to frequency downconvert a wireless communication signal received via antenna 218 and amplified by LNA 234 by an oscillator signal provided by oscillator 210 (e.g., downconvert to a baseband signal). Receive path 221 may further include a filter 238, which may be configured to filter a downconverted wireless communication signal in order to pass the signal components within a radio-frequency channel of interest and/or to remove noise and undesired signals that may be generated by the downconversion process. In addition, receive path 221 may include an analog-to-digital converter (ADC) 224 configured to receive an analog signal from filter 238 and convert such analog signal into a digital signal. Such digital signal may then be passed to digital circuitry 202 for processing.

FIGS. 3A-3E illustrate diagrams of various embodiments of multi-tap integrated transformers for use in one or more components of a transmitting and/or receiving element, in accordance with certain embodiments of the present disclosure. In embodiments of the present disclosure, the various multi-tap integrated transformers depicted in FIGS. 3A-3E may be integrated on a semiconductor chip.

Figure 3A:
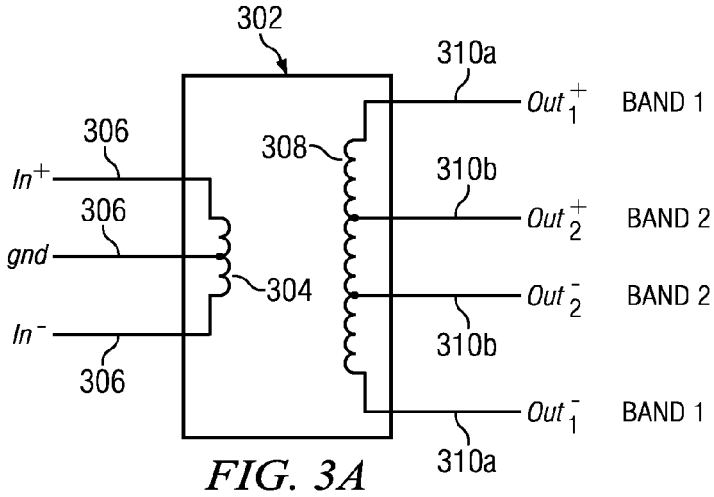
FIGS. 3A-3E illustrate diagrams of various embodiments of multi-tap integrated transformers for use in one or more components of a transmitting and/or receiving element, in accordance with certain embodiments of the present disclosure.

The embodiment of FIG. 3A depicts a multi-tap integrated transformer 302 with a single differential input (including an alternating current (AC) ground tap) and multiple differential outputs. As depicted in FIG. 3A, transformer 302 may include a primary winding 304 and a secondary winding 308 having mutual inductance. Primary winding 304 may include multiple taps 306 electrically coupled at different locations about primary winding 304. For example, two taps 306 may be coupled at or near the ends of primary winding 304 and may receive a differential input signal, as indicated by the notations $In^+$ and $In^-$. Another tap 306 may be coupled at or near the center of primary winding 304 and may be coupled to an AC ground voltage (e.g., a ground or direct current (DC) supply voltage), as indicated by the notation gnd. In addition, secondary winding 308 may include multiple taps 310 (e.g., taps 310*a* and 310*b*) electrically coupled at different locations about secondary winding 308. For example, two taps 310*a* may be coupled to secondary winding 308 at a first distance from each other, while two taps 310*b* may be coupled to secondary winding 308 at a second distance from each other, wherein the second distance is lesser than the first distance. In certain embodiments, taps 310*a* may be oriented about secondary winding 308 such that they are each approximately equidistant from the center of secondary winding 308 and/or taps 310*b* may be oriented about secondary winding 308 such that they are each approximately equidistant from the center of secondary winding 308. Taps 310*a* may output a first differential output signal as indicated by the notations $Out_1^+$ and $Out_1^-$, while taps 310*b* may output a second differential output signal as indicated by the notations $Out_2^+$ and $Out_2^-$.

In operation of transformer 302, the mutual inductance between the portion of primary winding 304 between taps 306 and the portion of secondary winding 308 between taps 310*a* may be different than the mutual inductance between the portion of primary winding 304 between taps 306 and the portion of secondary winding 308 between taps 310*b*. Accordingly, a differential input signal applied to taps 306 may induce a first differential output signal between taps 310*a* different than that of a second differential output signal between taps 310*b*. In addition, the inductance of secondary winding 308 between taps 310*a* and/or a load coupled to taps 310*a* may tune the first differential output signal for operation at a first frequency and the inductance of secondary winding 308 between taps 310*b* and/or a load coupled to taps 310*b* may tune the second differential output signal for operation at a second frequency different from the first frequency. Thus, multi-tap integrated transformer 302 permits signal transformation for multiple frequency bands (e.g., Band 1 for taps 310*a* and Band 2 for taps 310*b* as indicated in FIG. 3A) using a single transformer structure.

Figure 3B:
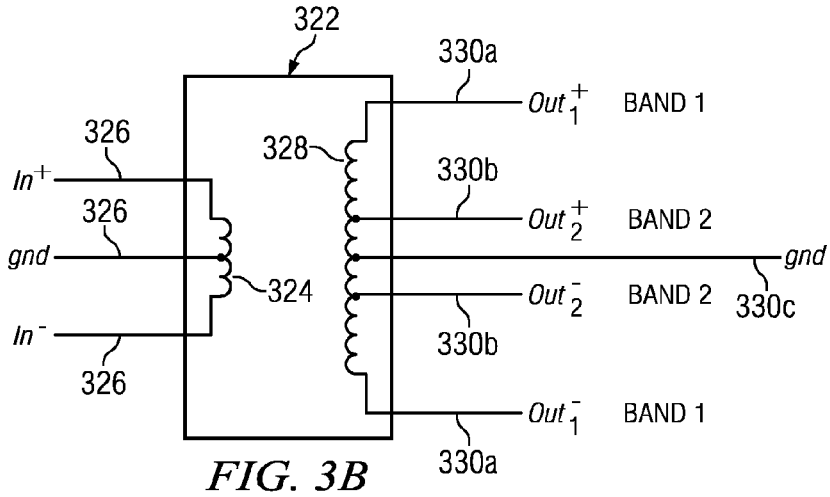

The embodiment of FIG. 3B depicts a multi-tap integrated transformer 322 with a single differential input (including an AC ground tap) and multiple differential outputs (including an AC ground tap). As depicted in FIG. 3B, transformer 322 may include a primary winding 324 and a secondary winding 328 having mutual inductance. Primary winding 324 may include multiple taps 326 electrically coupled at different locations about primary winding 324. For example, two taps 326 may be coupled at or near the ends of primary winding 324 and may receive a differential input signal, as indicated by the notations $In^+$ and $In^-$. Another tap 326 may be coupled at or near the center of primary winding 324 and may be coupled to an AC ground voltage (e.g., a ground or DC supply voltage), as indicated by the notation gnd. In addition, secondary winding 328 may include multiple taps 330 (e.g., taps 330*a*, 330*b*, and 330*c*) electrically coupled at different locations about secondary winding 328. For example, two taps 330*a* may be coupled to secondary winding 328 at a first distance from each other, while two taps 330*b* may be coupled to secondary winding 328 at a second distance from each other, wherein the second distance is lesser than the first distance. In certain embodiments, taps 330*a* may be oriented about secondary winding 328 such that they are each approximately equidistant from the center of secondary winding 328 and/or taps 330*b* may be oriented about secondary winding 328 such that they are each approximately equidistant from the center of secondary winding 328. Taps 330*a* may output a first differential output signal as indicated by the notations $Out_1^+$ and $Out_1^-$, while taps 330*b* may output a second differential output signal as indicated by the notations $Out_2^+$ and $Out_2^-$. In addition, another tap 330*c* may be coupled at or near the center of secondary winding 328 and may be coupled to an AC ground voltage (e.g., a ground or DC supply voltage), as indicated by the notation gnd.

In operation of transformer 322, the mutual inductance between the portion of primary winding 324 between taps 326 and the portion of secondary winding 328 between taps 330*a* may be different than the mutual inductance between the portion of primary winding 324 between taps 326 and the portion of secondary winding 328 between taps 330*b*. Accordingly, a differential input signal applied to taps 326 may induce a first differential output signal between taps 330*a* different than that of a second differential output signal between taps 330*b*. In addition, the inductance of secondary winding 328 between taps 330*a* and/or a load coupled to taps 330*a* may tune the first differential output signal for operation at a first frequency and the inductance of secondary winding 328 between taps 330*b* and/or a load coupled to taps 330*b* may tune the second differential output signal for operation at a second frequency different from the first frequency. Thus, multi-tap integrated transformer 322 permits signal transformation for multiple frequency bands (e.g., Band 1 for taps 330*a* and Band 2 for taps 330*b* as indicated in FIG. 3B) using a single transformer structure.

Figure 3C:
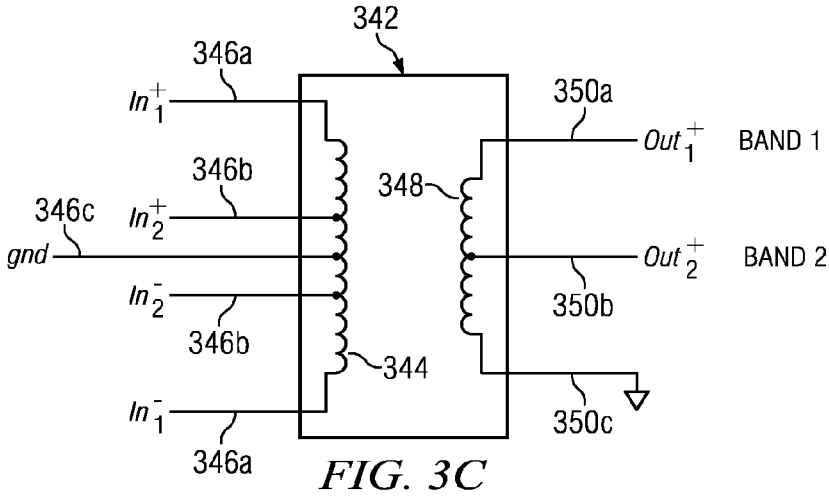

The embodiment of FIG. 3C depicts a multi-tap integrated transformer 342 with multiple differential inputs (including an AC ground tap) and multiple single-ended outputs. As depicted in FIG. 3C, transformer 342 may include a primary winding 344 and a secondary winding 348 having mutual inductance. Primary winding 344 may include multiple taps 346 (e.g., taps 346*a*, 346*b* and 346*c*) electrically coupled at different locations about primary winding 344. For example, two taps 346*a* may be coupled to primary winding 344 at a first distance from each other, while two taps 346*b* may be coupled to primary winding 344 at a second distance from each other, wherein the second distance is lesser than the first distance. In certain embodiments, taps 346*a* may be oriented about primary winding 344 such that they are each approximately equidistant from the center of primary winding 344 and/or taps 346*b* may be oriented about primary winding 344 such that they are each approximately equidistant from the center of primary winding 344. Taps 346*a* may receive a first differential input signal as indicated by the notations $In_1^+$ and $In_1^-$, while taps 346*b* may receive a second differential input signal as indicated by the notations $In_2^+$ and $In_2^-$. Furthermore, another tap 346*c* may be coupled at or near the center of primary winding 344 and may be coupled to an AC ground voltage (e.g., a ground or DC supply voltage), as indicated by the notation gnd. In addition, secondary winding 348 may include multiple taps 350 (e.g., taps 350*a*, 350*b* and 350*c*) electrically coupled at different locations about secondary winding 348. For example, a tap 350*a* may be coupled to secondary winding 348 at a first location, a tap 350*b* may be coupled to secondary winding 348 at a second location, and a tap 350*c* may be coupled to secondary winding 348 at a third location. Tap 350*c* may be coupled to an AC ground voltage (e.g., a ground or DC supply voltage), as indicated by the notation gnd. A first distance between taps 350*a* and 350*c* may be greater than a second distance between taps 350*b* and 350*c*. Tap 350*a* may output a first single-ended output signal as indicated by the notation $Out_1^+$, while tap 350*b* may output a second single-ended output signal as indicated by the notation $Out_2^+$.

In operation of transformer 342, a first mutual inductance may exist between the portion of primary winding 344 between taps 346*a* and the portion of secondary winding 348 between taps 350*a* and 350*c*. A second mutual inductance may exist between the portion of primary winding 344 between taps 346*b* and the portion of secondary winding 348 between taps 350*b* and 350*c*. Accordingly, a first differential input signal applied to taps 346*a* may induce a first single-ended output signal between taps 350*a* and 350*c*, and a second differential input signal applied to taps 346*b* may induce a second single-ended output signal between taps 350*b* and 350*c*. In addition, the inductance of secondary winding 348 between taps 350*a* and 350*c* and/or a load coupled to tap 350*a* may tune the first single-ended output signal for operation at a first frequency and the inductance of secondary winding 348 between taps 350*b* and 350*c* and/or a load coupled to tap 350*b* may tune the second single-ended output signal for operation at a second frequency different from the first frequency. Thus, multi-tap integrated transformer 342 permits signal transformation for multiple frequency bands (e.g., Band 1 for tap 350*a* and Band 2 for tap 350*b* as indicated in FIG. 3C) using a single transformer structure.

Figure 3D:
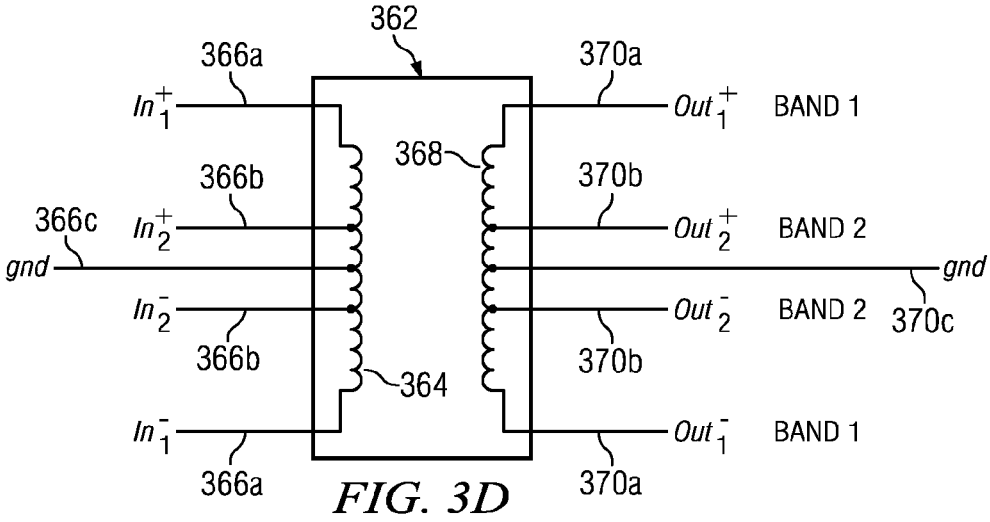

The embodiment of FIG. 3D depicts a multi-tap integrated transformer 362 with multiple differential inputs (including an AC ground tap) and multiple differential outputs (including an AC ground tap). As depicted in FIG. 3D, transformer 362 may include a primary winding 364 and a secondary winding 368 having mutual inductance. Primary winding 364 may include multiple taps 366 (e.g., taps 366*a*, 366*b* and 366*c*) electrically coupled at different locations about primary winding 364. For example, two taps 366*a* may be coupled to primary winding 364 at a first distance from each other, while two taps 366*b* may be coupled to primary winding 364 at a second distance from each other, wherein the second distance is lesser than the first distance. In certain embodiments, taps 366*a* may be oriented about primary winding 364 such that they are each approximately equidistant from the center of primary winding 364 and/or taps 366*b* may be oriented about primary winding 364 such that they are each approximately equidistant from the center of primary winding 364. Taps 366*a* may receive a first differential input signal as indicated by the notations $In_1^+$ and $In_1^-$, while taps 366*b* may receive a second differential input signal as indicated by the notations $In_2^+$ and $In_2^-$. Furthermore, another tap 366*c* may be coupled at or near the center of primary winding 364 and may be coupled to an AC ground voltage (e.g., a ground or DC supply voltage), as indicated by the notation gnd. In addition, secondary winding 368 may include multiple taps 370 (e.g., taps 370*a*, 370*b*, and 370*c*) electrically coupled at different locations about secondary winding 368. For example, two taps 370*a* may be coupled to secondary winding 368 at a first distance from each other, while two taps 370*b* may be coupled to secondary winding 368 at a second distance from each other, wherein the second distance is lesser than the first distance. In certain embodiments, taps 370*a* may be oriented about secondary winding 368 such that they are each approximately equidistant from the center of secondary winding 368 and/or taps 370*b* may be oriented about secondary winding 368 such that they are each approximately equidistant from the center of secondary winding 368. Taps 370*a* may output a first differential output signal as indicated by the notations $Out_1^+$ and $Out_1^-$, while taps 370*b* may output a second differential output signal as indicated by the notations $Out_2^+$ and $Out_2^-$. In addition, another tap 370*c* may be coupled at or near the center of secondary winding 368 and may be coupled to an AC ground voltage (e.g., a ground or DC supply voltage), as indicated by the notation gnd.

In operation of transformer 362, a first mutual inductance may exist between the portion of primary winding 364 between taps 366*a* and the portion of secondary winding 368 between taps 370*a*. A second mutual inductance may exist between the portion of primary winding 364 between taps 366*b* and the portion of secondary winding 368 between taps 370*b*. Accordingly, a first differential input signal applied to taps 366*a* may induce a first differential output signal between taps 370*a*, and a second differential input signal applied to taps 366*b* may induce a second differential output signal between taps 370*b*. In addition, the inductance of secondary winding 368 between taps 370*a* and/or a load coupled to taps 370*a* may tune the first differential output signal for operation at a first frequency and the inductance of secondary winding 368 between taps 370*b* and/or a load coupled to tap 370*b* may tune the second differential output signal for operation at a second frequency different from the first frequency. Thus, multi-tap integrated transformer 362 permits signal transformation for multiple frequency bands (e.g., Band 1 for tap 370*a* and Band 2 for tap 370*b* as indicated in FIG. 3D) using a single transformer structure.

Figure 3E:
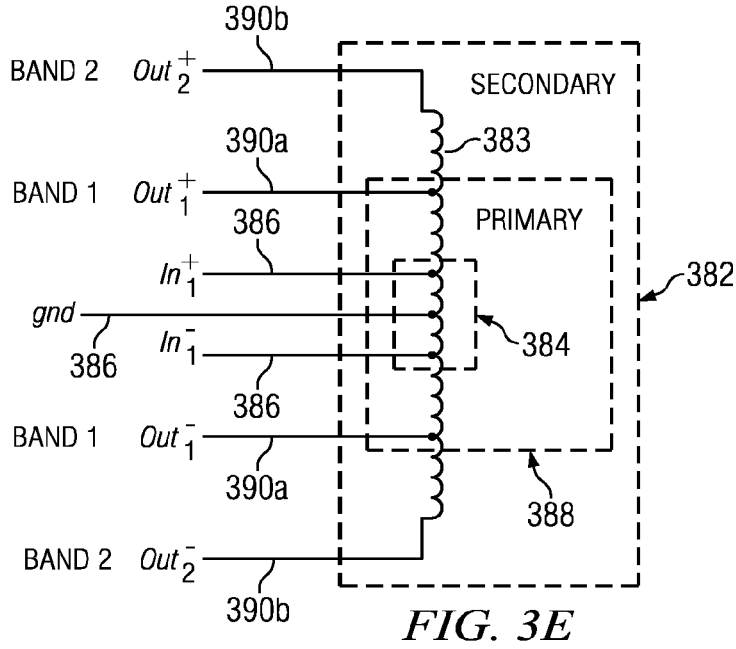

The embodiment of FIG. 3E depicts a multi-tap integrated transformer 382 with a single differential input and multiple differential outputs, including an AC ground tap. As depicted in FIG. 3E, transformer 382 may include a winding 383 with a primary portion 384 and a secondary portion 388, primary portion 384 and secondary portion 388 having mutual inductance. Primary portion 384 may include multiple taps 386 electrically coupled at different locations about primary portion 384. For example, two taps 386 may be coupled at or near the ends of primary portion 384 and may receive a differential input signal, as indicated by the notations $In^+$ and $In^-$. Another tap 386 may be coupled at or near the center of primary portion 384 (and/or at or near the center of winding 383) and may be coupled to an AC ground voltage (e.g., a ground or DC supply voltage), as indicated by the notation gnd. In addition, secondary portion 388 may include multiple taps 390 (e.g., taps 390*a* and 390*b*) electrically coupled at different locations about secondary portion 388. For example, two taps 390*a* may be coupled to secondary portion 388 at a first distance from each other, while two taps 390*b* may be coupled to secondary portion 388 at a second distance from each other, wherein the second distance is lesser than the first distance. In certain embodiments, taps 390*a* may be oriented about secondary portion 388 such that they are each approximately equidistant from the center of secondary portion 388 (and/or winding 383) and/or taps 390*b* may be oriented about secondary portion 388 such that they are each approximately equidistant from the center of secondary portion 388 (and/or winding 383). Taps 390*a* may output a first differential output signal as indicated by the notations $Out_1^+$ and $Out_1^-$, while taps 390*b* may output a second differential output signal as indicated by the notations $Out_2^+$ and $Out_2^-$.

In operation of transformer 382, a differential input signal applied to taps 386 may induce a first differential output signal between taps 390*a* different than that of a second differential output signal between taps 390*b*. In addition, the inductance of secondary portion 388 between taps 390*a* and/or a load coupled to taps 390*a* may tune the first differential output signal for operation at a first frequency and the inductance of secondary portion 388 between taps 390*b* and/or a load coupled to taps 390*b* may tune the second differential output signal for operation at a second frequency different from the first frequency. Thus, multi-tap integrated transformer 382 permits signal transformation for multiple frequency bands (e.g., Band 1 for taps 390*a* and Band 2 for taps 390*b* as indicated in FIG. 3E) using a single transformer structure. In operation, it may be necessary to AC couple taps 390*a* and 390*b* to other components (e.g., subsequent stages) via coupling capacitors.

Although transformers 302, 322, 342, 362, and/or 382 described above include specified numbers of taps and inputs, transformers 302, 322, 342, 362, and/or 382 may include any suitable number of taps and inputs (e.g., some implementations may include more than two differential inputs and/or more than two differential outputs).

Figure 4:
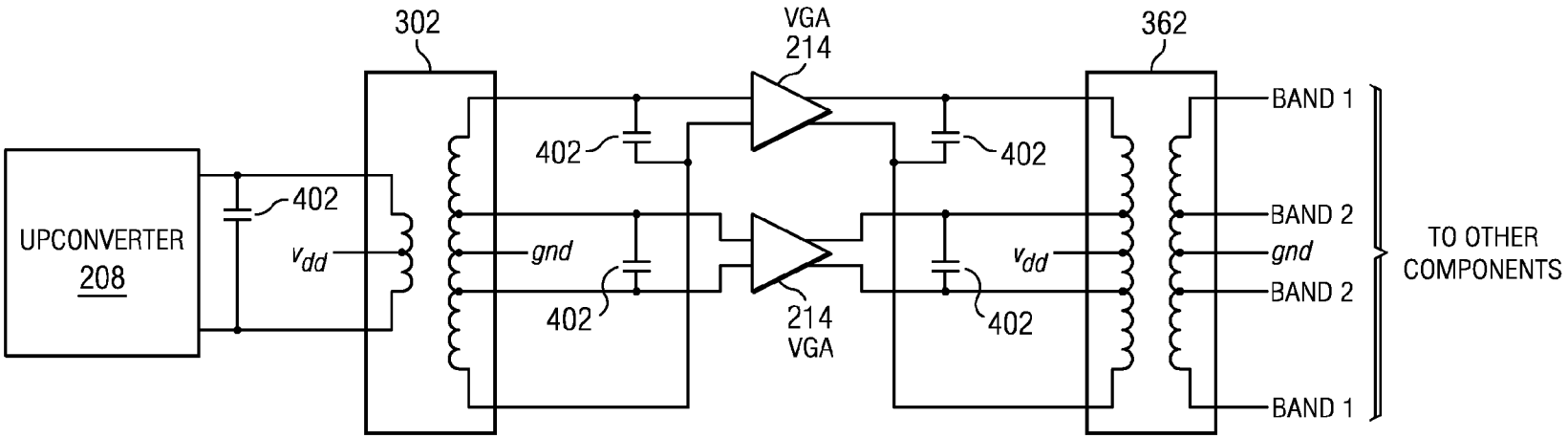
FIG. 4 illustrates a block diagram of an example application of multi-tap integrated transformers in a transmitting and/or receiving element, in accordance with certain embodiments of the present disclosure.

FIG. 4 illustrates a block diagram of an example application of multi-tap integrated transformers in a transmitting and/or receiving element, in accordance with certain embodiments of the present disclosure. In particular, FIG. 4 depicts selected components of a transmit path 201 including one or more of the transformers 302, 322, 342, 362, and/or 382 described above. As shown in FIG. 4, an upconverter 208 may output a differential signal. Such differential signal may be received by a first multi-tap integrated transformer (e.g., transformer 302) in which two different differential output signals are output from differential taps of first multi-tap integrated transformer. In certain embodiments, only one path (e.g., only one band) may be active. Accordingly, one of such differential outputs may be provided as input to a corresponding variable gain amplifier (e.g., VGA 214) where such signals may be amplified to produce an amplified differential signal. After amplification, the amplified differential signal may be communicated to its respective pair of differential input taps of a second multi-tap integrated transformer (e.g., transformer 362). The second multi-tap integrated transformer may transform the differential signal it receives into a differential output signal. These differential output signals may then be communicated to other components of transmit path 201 (e.g., bandpass filters, power amplifiers, etc.).

As shown in FIG. 4, tuning capacitors 402 and/or other components may be present to tune transformers or other portions of a wireless communication element 200 to a desired frequency. A desired frequency may be achieved by a resonant frequency created in accordance with the various inductances of transformers and capacitance of tuning capacitors 402

Modifications, additions, or omissions may be made to system 100 from the scope of the disclosure. The components of system 100 may be integrated or separated. Moreover, the operations of system 100 may be performed by more, fewer, or other components. As used in this document, "each" refers to each member of a set or each member of a subset of a set.

Although the present disclosure has been described with several embodiments, various changes and modifications may be suggested to one skilled in the art. It is intended that the present disclosure encompass such changes and modifications as fall within the scope of the appended claims.

What is claimed is:

1. A multi-tap integrated transformer comprising:

a primary winding having a plurality of primary winding taps coupled thereto, the plurality of primary winding taps including a pair of primary winding taps configured to receive a differential input signal; and a secondary winding having a plurality of secondary winding taps coupled thereto, the plurality of secondary winding taps including a first pair of secondary winding taps configured to output a first output signal and a second pair of secondary winding taps configured to output a second output signal, wherein:

the first output signal is based on the differential input signal and a first mutual inductance between a portion of the primary winding between the pair of primary winding taps and a first portion of the secondary winding between the first pair of secondary winding taps; and the second output signal is based on the differential input signal and a second mutual inductance between the portion of the primary winding between the pair of primary winding taps and a second portion of the secondary winding between the second pair of secondary winding taps, the second mutual inductance different than the first mutual inductance.

2. A transformer in accordance with claim 1, wherein a frequency of the first output signal is of a different frequency than the second output signal.

3. A transformer in accordance with claim 1, wherein at least one of:

each of the first pair of secondary winding taps is located approximately equidistant from the center of the secondary winding;

each of the second pair of secondary winding taps is located approximately equidistant from the center of the secondary winding; and each of the pair of primary winding taps is located approximately equidistant from the center of the primary winding.

4. A transformer in accordance with claim 1, the primary winding further including an alternating current ground tap configured to be coupled to a ground voltage or direct current supply voltage.

5. A transformer in accordance with claim 1, the secondary winding further including an alternating current ground tap configured to be coupled to a ground voltage or direct current supply voltage.

6. A transformer in accordance with claim 1, wherein the first portion of the secondary winding includes the second portion of the secondary winding.

7. A transformer in accordance with claim 1, wherein each of the first output signal and the second output signal comprise a differential signal.

8. A multi-tap integrated transformer comprising:

a primary winding having a plurality of primary winding taps coupled thereto, the plurality of primary winding taps including a first pair of secondary winding taps configured to receive a first differential input signal and a second pair of primary winding taps configured to receive a first differential input signal; and a secondary winding having a plurality of secondary winding taps coupled thereto, the plurality of secondary winding taps including a first pair of secondary winding taps configured to output a first output signal and a second pair of secondary winding taps configured to output a second output signal, wherein:

the first output signal is based on the first differential input signal and a first mutual inductance between a first portion of the primary winding between the first pair of primary winding taps and a first portion of the secondary winding between the first pair of secondary winding taps; and the second output signal is based on the second differential input signal and a second mutual inductance between a second portion of the primary winding between the second pair of primary winding taps and a second portion of the secondary winding between the second pair of secondary winding taps, the second mutual inductance different than the first mutual inductance.

9. A transformer in accordance with claim 1, wherein a frequency of the first output signal is of a different frequency than the second output signal.

10. A transformer in accordance with claim 8, wherein at least one of:

each of the first pair of secondary winding taps is located approximately equidistant from the center of the secondary winding;

each of the second pair of secondary winding taps is located approximately equidistant from the center of the secondary winding;

each of the first pair of primary winding taps is located approximately equidistant from the center of the primary winding; and each of the second pair of primary winding taps is located approximately equidistant from the center of the primary winding.

11. A transformer in accordance with claim 8, the primary winding further including an alternating current ground tap configured to be coupled to a ground voltage or direct current supply voltage.

12. A transformer in accordance with claim 8, the secondary winding further including an alternating current ground tap configured to be coupled to a ground voltage or direct current supply voltage.

13. A transformer in accordance with claim 8, wherein the first portion of the secondary winding includes the second portion of the secondary winding.

14. A transformer in accordance with claim 8, wherein the first portion of the primary winding includes the second portion of the primary winding.

15. A transformer in accordance with claim 8, wherein each of the first output signal and the second output signal comprise a differential signal.

16. A transformer in accordance with claim 8, wherein one of the first pair of secondary winding taps and one of the second pair of secondary winding taps comprises the same tap.

17. A multi-tap integrated transformer comprising:

a winding having a plurality of taps coupled thereto, the plurality of taps comprising:

a pair of primary taps configured to receive a differential input signal;

a first pair of secondary taps configured to output a first output signal; and a second pair of secondary taps configured to output a second output signal.

18. A transformer in accordance with claim 17, wherein a frequency of the first output signal is of a different frequency than the second output signal.

19. A transformer in accordance with claim 17, the winding further including an alternating current ground tap configured to be coupled to a ground voltage or direct current supply voltage.

20. A transformer in accordance with claim 17, wherein:

the second portion of the winding includes the first portion of the winding; and the third portion of the winding includes the first portion of the winding.

21. A transformer in accordance with claim 17, wherein the third portion of the winding includes the second portion of the winding.

22. A transformer in accordance with claim 17, wherein each of the first output signal and the second output signal comprise a differential signal.

* * * * *